United States Patent [19]

Perl

[11] 3,981,674

[45] Sept. 21, 1976

[54] CONTROL CIRCUIT AND ADJUSTABLE VALVE FOR A GAS APPLIANCE

[75] Inventor: Richard L. Perl, Mansfield, Ohio

[73] Assignee: The Tappan Company, Mansfield, Ohio

[22] Filed: June 5, 1975

[21] Appl. No.: 583,985

[52] U.S. Cl. ..... 431/67; 431/254

[51] Int. Cl.[2] ..... F23H 5/24

[58] Field of Search ..... 431/66, 67, 254; 317/98

[56] References Cited

UNITED STATES PATENTS

| | | | |
|---|---|---|---|
| 2,403,411 | 7/1946 | Strobel | 431/67 |
| 2,542,666 | 2/1951 | Hall | 431/67 |
| 3,551,084 | 12/1970 | Willson | 431/66 |
| 3,609,072 | 9/1971 | Willson | 431/66 |
| 3,862,820 | 1/1975 | Hantack | 431/66 |

*Primary Examiner*—Edward G. Favors

*Attorney, Agent, or Firm*—Donnelly, Maky, Renner & Otto

[57] ABSTRACT

A control circuit for a gas appliance includes ignition and hold circuits, the former providing for series energization of the heater of a thermal fuel valve and an electric igniter positioned proximate the appliance burner port area for ignition of the gas fuel and air mixture exiting the same and the latter providing for direct energization of only the igniter to hold or to maintain the appliance at a warm temperature. Moreover, the fuel valve includes an exterior selector mechanism for facile calibration and/or other adjustment for effective valve operation with either of two different gases at respectively different pressures, such as, for example, natural gas and bottled gas.

15 Claims, 7 Drawing Figures

CONTROL CIRCUIT AND ADJUSTABLE VALVE FOR A GAS APPLIANCE

BACKGROUND OF THE INVENTION

This invention is directed to a gas ignition and temperature holding arrangement for a gas appliance and, more particularly, to a control circuit selectively operable to effect the same. Moreover, this invention is directed to an externally adjustable fluid valve and, more particularly, to a thermal fuel valve readily adaptable for use with natural gas or bottled gas.

In view of the present focus on conservation of energy and, particularly, liquid and gas fuels, it is desirable to eliminate the constantly burning pilot lights often used in gas appliances. In the interest of safety it is also important to control gas flow in gas appliances to avoid such flow without combustion.

The conventional automatic controls for a gas appliance have required relatively complex control systems, usually including one or more solenoid valves, timer switches, and a normally burning pilot light. Also, the usual technique for maintaining the temperature of an oven, for example, at a constant relatively low temperature to keep food warm without appreciable cooking has been to burn gas under control of the thermostatic selector switch, which is adjusted, say, to about 160° to 170° F.

Conventional gas appliance fuel valves are normally designed for use with either natural gas supplied at a four inches pressure or bottled gas, such as liquid propane, supplied at ten inches pressure.

SUMMARY OF THE INVENTION

In the instant invention a control circuit includes an ignition circuit for series energization of a thermal fuel valve and an electric igniter, which are related such that the valve will not open until the temperature of the igniter is approximately at that at which the fuel will ignite. The control circuit also includes a hold circuit that provides for direct energization of only the igniter, which supplies heat, for example, in an oven to maintain the same at a relatively warm temperature, say in the range of approximately 160° to 170° F. The control circuit may be manually operated or it may be operated in an automatic mode under control of a timer operated switch.

Moreover, the fluid valve of the invention includes a housing having an inlet and an outlet; a valve element, a support therefor, and a valve operating means all located in the housing and actuable to open and close the valve; and an adjustment or calibration mechanism operable exteriorly of the housing for adjusting the mounted position of the valve element support with respect to the housing for adjustment of the mechanical bias force that normally maintains the valve element closed against a valve seat to close the outlet. In one form the adjustment mechanism includes a pivot lever and a bias spring operated by a pivot screw and nut combination, and in another form the bias spring is replaced by a partially corrugated relatively rigid diaphragm, which also provides for an improved valve sealing arrangement.

With the foregoing in mind, it is a primary object of the invention to provide automatic control for a gas appliance.

Another object of the invention is to maintain a warm temperature in a gas appliance without burning gas.

An additional object of the invention is to conserve fuel by eliminating from a gas appliance the normally burning pilot light or lights.

A further object of the invention is to effect cooking food and thereafter to maintain the cooked food at a warm temperature without further appreciably cooking the same in a gas appliance.

Still another object of the invention is to provide for manual and/or automatic control of a gas appliance to perform cooking and holding functions.

Still an additional object of the invention is to facilitate the calibration and adjustment of a fluid valve and, particularly, of a thermal fuel valve.

Still a further object of the invention is to facilitate adapting a thermal fuel valve for use with gas at different pressures and, more particularly, natural or bottled gas.

Even another object of the invention is to provide external adjustment of a fuel valve.

Even an additional object of the invention is to adapt a thermal fuel valve and electric igniter combination for safe, effective and efficient use with either natural or bottled gas by means of a single mechanical adjustment.

These and other objects and advantages of the present invention will become more apparent as the following description proceeds.

To the accomplishment of the foregoing and related end, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

DESCRIPTION OF THE PREFERRED EMBODIMENTS

Figure 1:
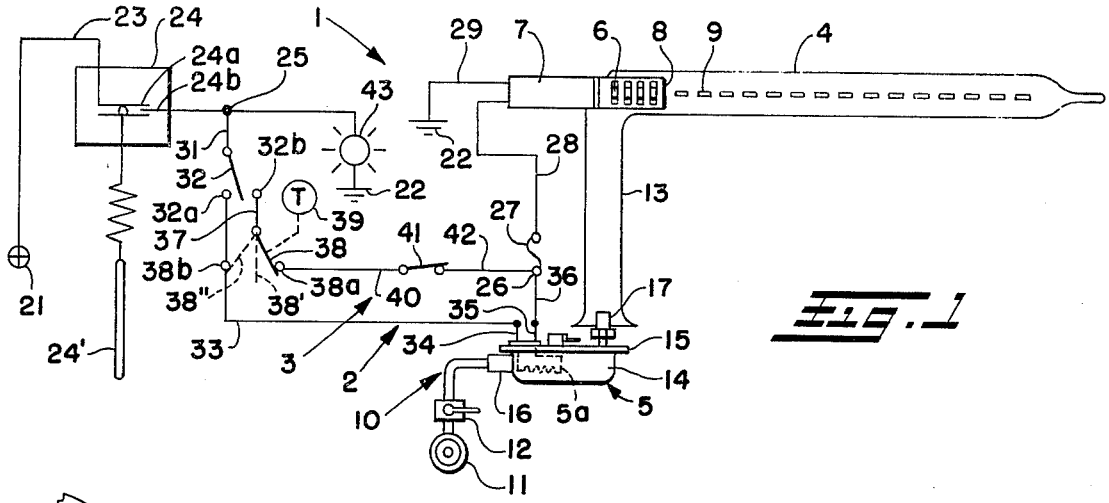
FIG. 1 is a schematic diagram, including electrical and mechanical portions, of the control circuit of the invention in relation to a thermal fuel valve and a gas appliance burner.

In referring particularly to the drawings, wherein like reference numerals designate like parts in the several figures, the invention will be described below with relation to a control circuit and thermal fuel valve for a domestic gas oven appliance. It will, of course, be appreciated that the principles of the invention may be readily applicable to other types of gas appliances, and, moreover, the thermal fuel valves also may be used in other types of fluid systems.

The control circuit 1 of the invention, including an ignition circuit portion 2 and a hold circuit portion 3, is depicted in FIG. 1 in relation to a conventional gas burner 4 of a gas oven appliance, which receives a supply of gaseous fuel from a thermal fuel valve 5. An electric igniter 6, which is mounted within a holding package that includes, for example, a ceramic holder 7 and a surrounding perforate shield 8, is coupled in the control circuit 1 for energization thereby to generate sufficient heat for ignition of the gas-air mixture emitted at the ports 9 of the burner 4.

In the preferred embodiment the electric igniter 6 is formed of silicon carbide material having a low temperature portion, including terminal parts to which electrical leads are attached, for example, in the manner shown in my U.S. Pat. No. 3,842,319, issued Oct. 15, 1974, and a high temperature portion, including plural helical or rectangular turns at which appreciable heat is generated when electric current flows therethrough. The silicon carbide igniter is preferably rated at approximately 300 watts and 120 volts in order to generate sufficient heat to effect fuel ignition and also to hold the oven temperature at approximately 160° to 170°F. when energized alone. It will, of course, be appreciated that the igniter may be otherwise rated provided it is capable of effecting the ignition and holding functions, and it will also be understood that other igniter materials may be used, such as, for example, molybdenum disilicide or other materials that generate sufficient heat for the intended purposes. A particular advantage, however, to the silicon carbide type igniter is the negative coefficient of resistance parameter over a portion of its temperature range up to a temperature somewhat above that at which a mixture of natural or bottled gas and air ignites to ensure achieving ignition temperature and the positive coefficient of resistance over the next higher portion of its temperature range that makes such igniter effectively self-limiting in terms of both temperature and current flow therethrough.

The thermal fuel valve 5 is located in the gaseous fuel supply line 10 to the burner, including a gas source supply connection 11, a manual gas shut off valve 12 and a gas-air mixture chamber 13 that supplies a gas-air mixture directly to the gas burner 4. The thermal fuel valve 5 is in the form of a sealed housing, which comprises a stamped or die cast hollow can 14 to which a cover 15 is attached in sealed relation. A gas input 16 receives a supply of gas from the connection 11 and an internal valve actuator mechanism controls gas flow to the gas spud 17 so that when the thermal fuel valve is open gas flows from the spud and mixes with air drawn in about the latter in the mixing chamber 13 for supply to the gas burner 4.

One type of thermal fuel valve that may be used in the instant invention is disclosed in my copending U.S. Pat. application Ser. No. 432,457, filed Jan. 11, 1974, which is a continuation of my earlier filed Pat. application Ser. No. 223,451, filed Feb. 4, 1972. Alternatively, and in the preferred embodiments of the instant invention, the thermal fuel valves described in more detail below with reference to FIGS. 2 through 6 may be used for energization in the control circuit 1 of the present invention. In either event, the internal valve actuator mechanism of the thermal fuel valve 5 preferably includes an electric heater and a heat responsive actuator that effects movement of a valve element to open and close the gas outlet 17 depending on whether an adequate supply of electrical energy is provided to the internal heater. Moreover, although the preferred form of gas valve used in the present invention is a thermal fuel valve, it is to be understood that other types of valves and/or valve actuators also may be used in combination with the control circuit 1. For example, a current sensing relay may operate contacts to energize a solenoid valve, one or more solenoid operated valves may be substituted for the thermal fuel valve 5, for example, as shown in U.S. Pat. No. 3,826,605, etc.

The control circuit 1 includes a pair of power terminals 21, 22, which are preferably directly connectable to a conventional AC receptacle outlet in a home to receive 110–120 volts, 60 Hz power from the utility company and, for convenience of description, the former is shown and described as an input terminal to the circuit and the latter is shown and described as a ground output terminal. It will, of course, be appreciated that the control circuit 1 may receive power at other AC or DC voltages by simply using elements in the control circuit that have appropriate power ratings.

In the control circuit 1 a lead 23 supplies power from the input terminal 21 via a conventional thermostatic selector switch 24 to a nodal point 25, and the latter is connectable via either one of the parallel coupled ignition and hold circuit portions 2, 3 to another nodal point 26 from which the power is supplied via a fuse 27 and a lead 28 to one terminal of the electric igniter 6. The other terminal of the electric igniter is connected by a lead 29 to the ground or output power terminal 22. Preferably the fuse 27 is of a rating such that it will burn out before either the valve heater or the electric igniter 6 would burn out, and, moreover, the valve heater is preferably of a rating such that it will burn out before the electric igniter 6 would burn out, especially when no fuse is used. Therefore, if a short circuit were to occur in the control circuit 1, a brief high current would flow therein until the fuse 27 blows or the valve heater burns out, with either event interrupting actuating power to the thermal fuel valve 5 causing the same to close.

In the ignition circuit portion 2 electric power may flow between the two nodal points 25, 26 via a lead 31, a manual on-off selector switch 32, a lead 33, input and output terminals 34, 35 to the thermal fuel valve electric heater, schematically shown at 5*a*, and a lead 36. Alternatively, electric power may flow between the nodal points 25 and 26 via the hold circuit portion 3, which includes a lead 37, a switch 38 operated by a timer 39, a lead 40, a hold switch 41, and a further lead 42. Moreover, whenever the control circuit 1 is energized, an on indicator light 43, which is coupled between the nodal point 25 and the ground output terminal 22 will be illuminated to provide a visual indication of such energization.

When the thermostatic selector switch 24 is in its off position, the contacts 24*a*, 24*b* remain open, and no electric power flows in the control circuit 1. The contacts 24*a*, 24*b* will, of course, remain closed when the thermostatic selector switch 24 is adjusted for broiling, and when the switch 24 is adjusted for oven baking or the like operation at a predetermined temperature, the contacts 24*a*, 24*b* will close and open under control of an oven temperature sensor 24'.

The control circuit 1 in conjunction with the thermal fuel valve 5 is capable of oven control in several operative modes, including, for example, conventional instant starting and operation for baking and broiling, delayed starting, maintaining the oven warm using only the igniter 6 before and/or after baking or broiling operations and/or independently of burner usage, and so on. Several operative examples are presented below.

To effect manual operation of the control circuit 1 for baking or broiling in the oven, the manual on-off selector switch 32 is closed to engage a contact 32*a*, and the thermostatic selector switch 24 is adjusted to the desired oven temperature or to the broiling position; accordingly, a closed circuit path for power flowing in the control circuit 1 may be traced from the input power terminal 21 via the thermostatic selector switch 24, nodal point 25, the igniter circuit 2, including the thermal fuel valve electric heater 5*a* to be later shown in detail, the fuse 27, and the electric igniter 6 to the output terminal 22. The initial current flowing through the electric igniter 6 causing the same to begin increasing in temperature is inadequate to effect a temperature increase in the valve electric heater sufficient to open the thermal fuel valve 5. However, as the temperature of the electric igniter 6 increases, its resistance decreases, and a larger electric current flows through the control circuit 1 until the electric igniter is approximately at the temperature at which it will assuredly ignite the gas-air mixture flowing from the burner ports 9; and approximately at that point the valve heater current and temperature will operate the valve actuator to open the thermal fuel valve 5 supplying gas to the burner 4. Of course, whenever either the manual switch 32 or the contacts 24*a*, 24*b* open, the control circuit current will cease, and the valve 5 and igniter 6 will be de-energized.

The timer switch 38 may be normally in engagement with its contact 38*a* to provide a circuit to heat and/or to maintain the oven temperature at approximately 160° to 170° F., well below the normal cooking temperatures on the order of 275° to 400° F. and broiling temperatures above 550°F., which circuit includes the manual on-off selector switch 32 in selected engagement with the contact 32*b* and the closed hold switch 41. Thus, a closed circuit path is provided between the nodal points 25, 26 via lead 37, timer switch 38, and the rest of the hold circuit portion 3. When the contacts of the thermostatic selector switch 24 are then closed, the hold circuit portion 3 is energized to supply current directly to the electric igniter 6, which generates sufficient heat, preferably to maintain the oven temperature at approximately 160° to 170° F., for example, to expedite defrosting frozen foods, to warm dishes, to maintain already cooked foods warm, and the like. During such holding operation the control circuit 1 is self-regulating to maintain a relatively constant steady state current through the electric igniter 6, which achieves a relatively steady state resistance according to its temperature-resistance characteristic.

The control circuit 1 readily lends itself to automated control using the timer switch 38 for controlling operation of the oven in an automatic mode. To effect such operation, the thermostatic selector switch 24 is adjusted to the desired oven cooking temperature; the manual on-off selector switch 32 is closed to contact 32*b*; and the hold switch 41 is closed. The timer 39 is adjusted to the desired time at which the oven is to begin cooking food placed therein and for the desired cooking duration; and such timer adjustment effects movement of the timer switch 38 to the neutral position shown at the dotted line 38′. At the prescribed time, the timer 39 throws the timer switch 38 into connection with the contact 38*b*, as shown by the dotted line 38″, effecting operation of the ignition circuit 2 to provide power to the series connected thermal fuel valve 5 and electric igniter 6 for operation in the manner described above. After the prescribed cooking duration has expired, the timer 39 moves the timer switch 38 back into connection with the contact 38*a* to de-energize the ignition circuit 2 and to energize the hold circuit 3, whereby the thermal fuel valve 5 closes and the electric igniter 6 maintains the oven and the food therein at the hold temperature until the control circuit 1 is manually de-energized by opening the contacts of the thermostatic selector switch 24 or by opening the hold switch 41.

Depending on the functional capability of the timer 39 and its associated timer switch 38, the control circuit 1 may be operated in its automatic mode in a number of other ways. For example, at the conclusion of the above-described operation, the timer 39 may automatically throw the switch 38 back to its neutral position at 38′, thus opening the hold circuit 3. Moreover, the timer may first energize the hold circuit to defrost frozen food for a predetermined time, thereafter energize the ignition circuit to cook the food, thereafter re-energize the hold circuit to maintain the cooked food at a warm temperature, etc. Of course, as another example, a simplified timer may only be capable of being set for immediate energization of the igniter circuit for a predetermined cooking duration and then automatically switch to energize the hold circuit, thus eliminating the neutral position 38′ of the timer switch.

Also, since the holding circuit is in series with both the selector switch 32 and the timer switch 38, the switch 41 may be replaced by a direct short circuit. However, without changing the timer 39 and using the switch 41, for example as part of a multiple selector switch with the switch 32, the hold circuit could be cut out so as to provide for operation of the control circuit 1 respectively in manual, automatic time cook, and automatic time cook and hold modes.

As described in my above-mentioned copending U.S. Pat. application Ser. No. 432,547, it is desirable and usually necessary to provide for calibration of the control circuit 1 and, particularly, for calibration of the thermal fuel valve 5 with respect to the electric igniter. Such calibration may be effected either under actual or, at the least, under simulated operating conditions.

Calibration under actual operating conditions dictates that the electric igniter 6 itself and the electric heater 5*a* of the valve 5 be series connected and supplied with electric power while at the same time a supply of gas under its normal supply pressure is also provided the valve at its inlet 16. The valve 5 is then adjusted, for example, using an external adjustment or other means to vary the bias force on the valve element or valve poppet so that the latter will lift from the valve seat to allow gas flow from the valve outlet only when adequate electric current flows through the ignition circuit, including the valve heater and the electric igniter, heating both and particularly the latter at least to a minimum suitable temperature for ignition of gas-air mixture, which ignition may be observed. Such calibration technique fully compensates for any cooling affect by the gas on the valve heater and any pressure affect of the gas on the valve poppet, as well as any peculiar parameters of the valve and/or the igniter.

Since it is undesirable for both safety and ecological reasons to use gas during valve calibration, the affects of the gas on the valve may be simulated by supplying to the valve inlet 16 air at the same gas pressure and the proper temperature with consideration given to the different specific heats of natural gas, bottled gas, and air in order to provide comparable pressure and cooling affects on the valve elements for effective calibration purposes. Of course, during such simulated conditions no ignition would be observed because there would be no gas to ignite. Moreover, if the igniter parameters are known, as evident from my earlier application, then the igniter electrical properties also may be simulated by substitution either of a fixed or variable resistance having or adjustable to a resistance equal to that of the igniter at the mentioned temperature; alternatively, a controlled current source for supplying current to the valve heater at a level at which current would flow through the igniter when the latter is at the mentioned ignition temperature could be used for effecting valve calibration to preclude its opening unless current is at the noted level. A particular advantage attendant to the latter calibration technique of the valve by itself, when the igniter parameters have been established, is that the valve itself may be calibrated and immediately tested during its manufacture rather than after its incorporation in a gas appliance, and replacement, for example, of the valve by another similarly calibrated valve or of the igniter in the event of failure can easily be made.

Figure 2:
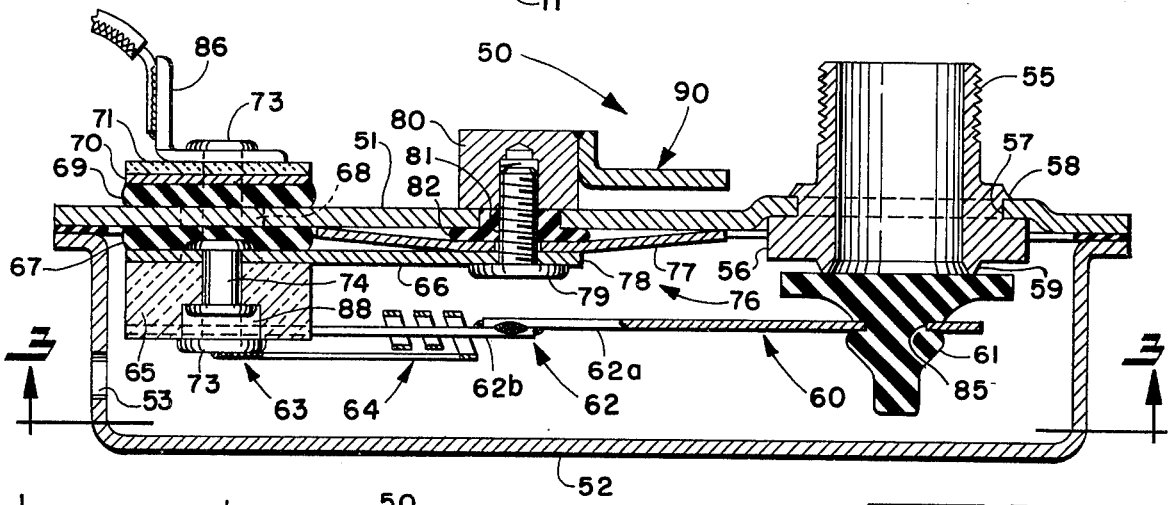
FIG. 2 is an elevation view in section of the cover and operative portions of a thermal fuel valve in accordance with the invention.
Figure 3:
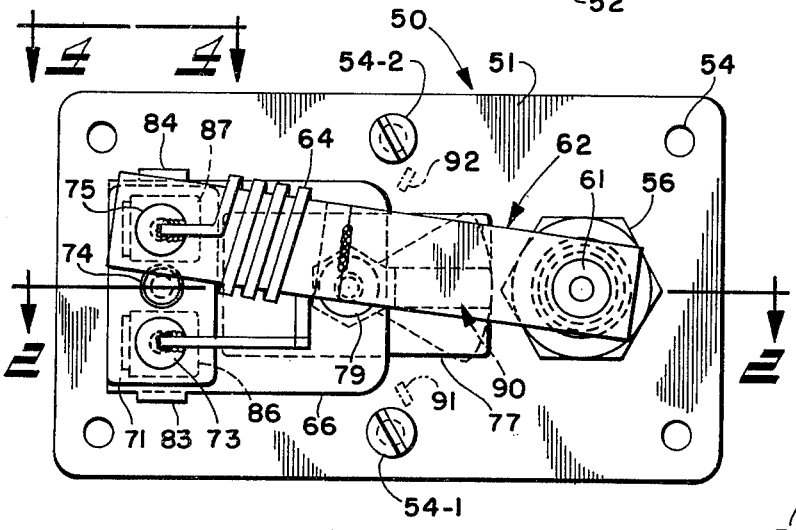
FIG. 3 is a bottom plan view of the valve cover and operative portions looking in the direction of the arrows 3—3 of FIG. 2.
Figure 4:
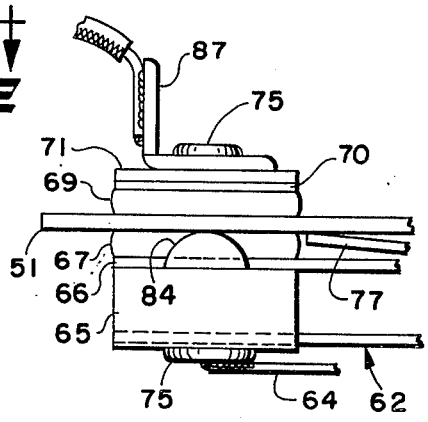
FIG. 4 is a partial side elevation view of a portion of the thermal fuel valve looking in the direction of the arrows 4—4 of FIG. 3.

Turning now more specifically to FIGS. 2, 3, and 4, a thermal fuel valve in accordance with the invention is generally indicated at 50. The valve includes a housing defined by a cover plate 51 and a hollow can 52, which correspond, for example, to the valve cover 15 and can 14 illustrated in FIG. 1. The can 52 may be die cast or stamped in conventional manner and has a gas inlet opening 53 provided for brazed attachment of an input fitting. The can is preferably attached to the valve cover plate 51 using a gasket and fasteners such as screws 54-1 and 54-2 through holes 54 in the cover plate to provide a sealed valve housing. The valve gas outlet is in the form of a threaded fitting 55, which has a hexagonal profile portion 56 coined into position in the cover plate 51 with a portion extending through the opening 57 for external fluid connection. Preferably a quantity of general purpose adhesive material, such as that sold under the name Pliobond manufactured by the Goodyear Tire and Rubber Company, Akron, Ohio, is used to coat the fitting portion that is coined in engagement with the cover plate 51 for fluid sealing purposes, and the fitting is also mechanically staked about its periphery 58 to lock the same from engagement with the valve cover. A valve seat 59 is formed by a raised circular portion of the fitting 55, which may be formed, for example, of plated cold rolled steel.

Within the housing of the thermal fuel valve 50 is a valve actuator mechanism 60, which includes a poppet or valve element 61, which may be formed of silicone rubber, supported on a two part elongated bimetal assembly 62 that is in turn mounted for a relatively small amount of pivotal movement with respect to the valve cover plate 51 by a mounting structure 63 for calibration and biasing purposes, as will be described in more detail below. Normally, however, the bimetal assembly 62 applies a mechanical bias force to the poppet 61 urging the same into engagement with the valve seat 59 to close the valve. The valve actuating means is preferably an insulated electric ribbon type heater 64, which when energized with electric current heats the bimetal assembly causing the same to bend moving the poppet downward to open the valve outlet, as is described, for example, in my above-mentioned copending patent application.

The mounting structure 63 includes a ceramic or other relatively rigid electrically non-conductive block 65, a stainless steel pivot lever plate 66, a plurality of gaskets 67, 68, 69, of silicone rubber or other relatively resilient electrically non-conductive material, a stainless steel terminal plate 70, and a Micalex insulator plate 71. The block 65 and the pivot lever plate 66 are secured to each other by a short rivet 74. The mounting structure elements are all fastened together through an opening 72 in the cover plate 51 by two rivets 73, 75, and the mounting structure is reasonably securely fastened to the cover plate by the gaskets 67, 68, 69, which allow for some pivotal movement of the mounting structure with respect to the cover plate. Moreover, the bimetal assembly 62 may be firmly secured to the mounting structure by the rivet 75 in a groove formed in the block 65.

A biasing mechanism 76 for the thermal fuel valve 50, includes a dished pivot spring 77 that normally urges the moment arm end 78 of the pivot lever 66 away from the inside surface of the valve cover plate 51, while at the same time a pivot screw 79 and blind nut 80 assembly draws the moment arm end toward the cover plate tending to flatten the spring. The pivot screw 79 passes through an opening 81 in the cover plate 51 and a pivot gasket 82, for example, of silicone rubber or like material seals the opening to prevent gas leakage. By tightening or loosening the blind nut 80 against the force of the pivot spring 77, the moment arm of the pivot lever 66 is moved closer or further, respectively, from the inside surface of the valve cover plate, thus effecting a slight pivoting or tilting of the mounting structure 63 with respect to the cover plate 51. Counterclockwise pivoting of the mounting structure 63 caused by tightening of the blind nut 80 will effect an increase in the mechanical bias force which the bimetal assembly 62 exerts on the poppet 61 to maintain the same closed against the valve seat 59; similarly, clockwise pivoting of the mounting relief of that mechanical bias force.

Moreover, in order to facilitate the above-mentioned pivoting action as the blind nut 80 is tightened or loosened, a pair of semi-circular ears 83, 84 may be formed on the pivot lever, as is more clearly illustrated in FIGS. 3 and 4. The pivot ears provide a relatively fixed pivot point on the pivot lever plate 66, additional structural strength to the mounting structure 63 and some degree of protection for the gasket 67 in particular to avoid damage to the same as operating pressures vary in the valve.

The two part bimetal assembly 62, which supports the poppet 61 and is actually the actuator therefor, is preferably formed of two welded bimetal elements **62*a*, 62*b*, the former being, for example, formed of a material known as Veriflex, and the latter being formed, for example, of a material known as Saflex, which have been manufactured by the H. A. Wilson Company, a division of Engelhard Industries, Inc., Newark, New Jersey. The bimetal element 62*a* has an opening 85 into which the poppet 61 may be snapped, and such element provides a compensation function for the bimetal assembly 62 in order to maintain the valve outlet closed until the more rapidly heat responsive bimetal element 62***b* is at a predetermined temperature effected by a predetermined current flowing through the heater ribbon 64. Alternative combinations of bimetal elements, combinations of a bimetal element and a non-bimetal element, or a single bimetal element may be used in the bimetal assembly 62 to achieve the desired function of maintaining the valve outlet closed until the heater 64 has reached a predetermined temperature. Obviously, the valve 50 also may be designed for use in some fluid systems to maintain a normally opened condition until the heater 64 is energized to close the same.

The heater wire 64 may be formed, for example, of Nichrome flat ribbon surrounded with an electrically insulating material, and power to the wire may be supplied through welded connections of the ends of the same to respective heads of the rivets 73, 75. The rivets are electrically conductive and have respective brass electrical terminals 86, 87 attached to the upper rivet portions above the insulator plate 71 for connection, for example, to the leads 33, 36 in the igniter circuit 2 shown in FIG. 1. To avoid interference with the bimetal element 62*b* the central rivet 74 terminates at its lower end in a recess 88 in the ceramic block 65. Also, it may be desired for heat transfer between the heater wire 64 and the bimetal elements 62*b* to use a heater wire, either of circular or of a ribbon-shape crosssection which may be welded to the bimetal element 62b.

The thermal fuel valve 50 is calibrated to effect opening of the valve outlet 55 by a lifting of the poppet 61 from the valve seat 59 when the heater 64 achieves a predetermined temperature. The mentioned temperature will be achieved when the current through the heater wire is at a predetermined level, and since the heater is preferably connected in series circuit with the electric igniter 6 of FIG. 1, that current will be achieved preferably when the electric igniter is at the temperature approximately at which the gas fuel will ignite. Calibration of the thermal fuel valve 50 under actual or simulated operating conditions, as described above, may be effected after assembly by rotation of the blind nut 80 until it is ascertained that the valve will remain closed until the heater 64 comes up to temperature at which point the valve will open.

The facile calibration technique for the thermal fuel valve 50 enables the same to be adjusted readily for use either with natural gas, which is usually provided at approximately a four inches pressure, or with bottled gas, such as liquid propane, which is normally provided at approximately ten inches pressure. The higher pressure gas will exert a larger force on the relatively large surface area of the valve poppet 61 to bias the same closed than the force which would be exerted by the lower pressure gas. Therefore, a thermal fuel valve 50 that has already been calibrated for use with bottled gas may be recalibrated for use with natural gas by tightening the blind nut 80 against the pivot screw 79, which causes the mounting structure 63 to pivot in a counterclockwise direction to increase the mechanical bias force exerted by the bimetal assembly 62 to maintain the poppet 61 closed. If necessary, this calibration technique also may take into account the different ignition temperatures and specific heats of the different gases, whereby provision would obviously be made to preclude valve opening until the electric igniter has achieved a suitable temperature for gas ignition.

In the preferred embodiment of the invention less than one full revolution of the blind nut 80 is required to switch from valve calibration for use with ten inches pressure gas to proper calibration for use with four inches pressure gas. Therefore, after the thermal fuel valve 50 has been calibrated for use, for example, with ten inches pressure gas by adjustment of the nut 80, a handle 90 may be welded to the nut so that one edge of the handle is approximately in abutment with the head of the screw 54-1. The width of the handle 90 is selected so that movement thereof to abutment with the head of the other screw 54-2 will cause enough rotation of the blind nut 80 to effect valve calibration for use with four inches pressure gas. Alternatively, a calibration handle 90 of fixed width may be used and stops 91, 92 may be welded to the top of the cover plate to serve a function similar to the mentioned screw heads. The thermal fuel valve 50 then may be readily used with either natural or bottled gas simply by shifting the handle 90 to engagement with the appropriate respective stop 91, 92.

The thermal fuel valve 50 operates with some degree of snap action, which is highly desirable to avoid any occurrence of flash back from a hot burner. This snap action advantage is achieved using a poppet 61 that has a relatively large surface area and a relatively large cross-section valve seat 58. Thus, when the valve is closed, a large force exerted by the gas in the valve housing urges the poppet 61 closed against the valve seat, and that force to some extent also opposes any lifting force exerted by the bimetal assembly 62 as the heater 64 is energized. However, as soon as the poppet has lifted slightly from the valve seat to permit gas to flow through the outlet 55, the closing pressure exerted by the gas on the poppet is equalized, and the over driven bimetal assembly rapidly moves the poppet to a full opened position and maintains the same open even though the flowing gas applies some cooling affect to the bimetal assembly.

Figure 6:
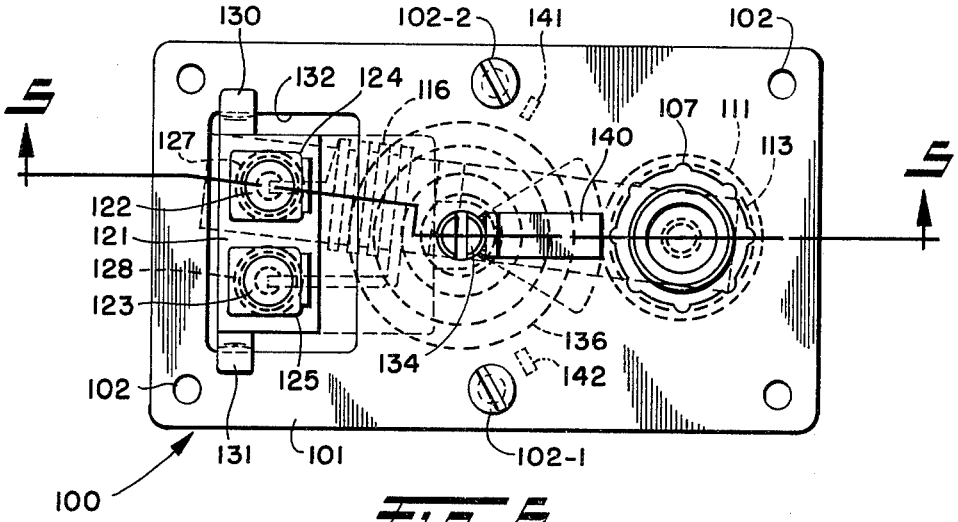
FIG. 6 is a plan view of the top of the valve cover and operative portions looking in the direction of arrows 6—6 of FIG. 5.
Figure 5:
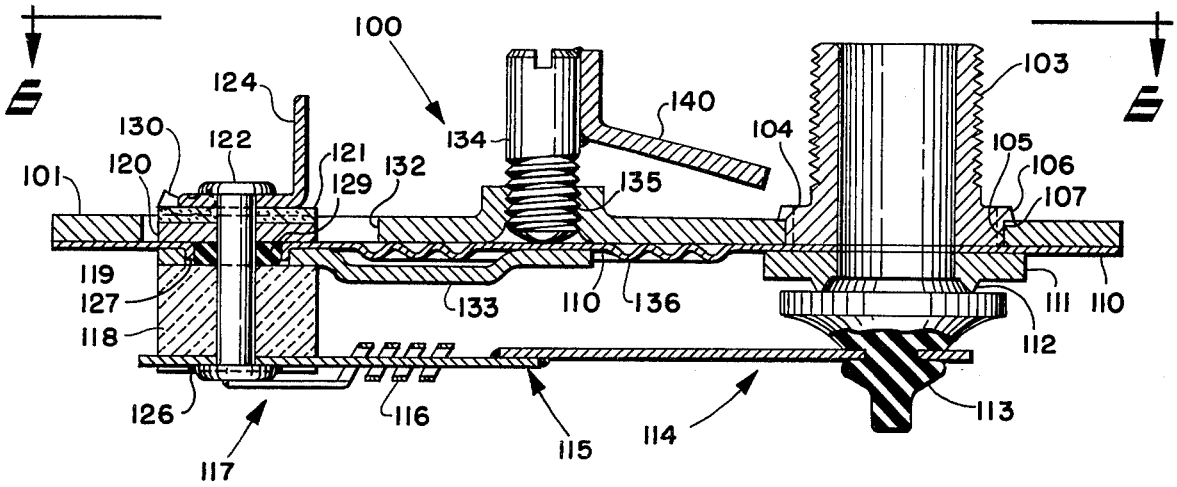
FIG. 5 is an elevation view in section of the cover and operative portions of a modified thermal fuel valve.
Figure 7:
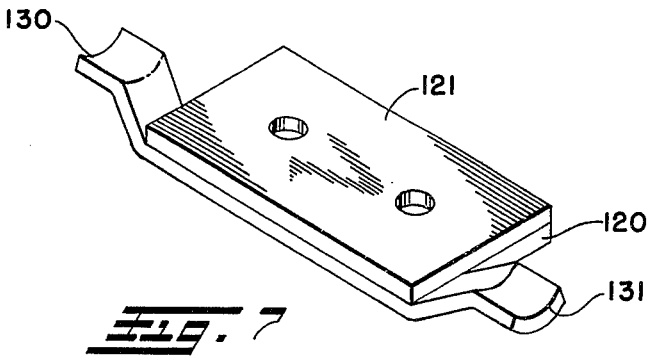
FIG. 7 is an isometric view of the pivotal support for the mounting structure of the modified valve of FIGS. 5 and 6.

Referring now more specifically to FIGS. 5, 6 and 7, a modified thermal fuel valve is generally indicated at 100. The modified valve includes a valve cover plate 101, which would be attached by screws through the holes 102 to a stamped or die cast can, not shown, to form a valve housing. Such valve housing would, of course, have a valve inlet as described above with reference to FIG. 2, and the valve fitting 103 would form the valve outlet. The fitting may be formed, for example, of threaded ⅜ inch tubing having enlarged lower flange portion 104 that is forced into an opening 105 in the valve cover 101. The outlet fitting 103 is mechanically staked into permanent position at 106, and a number of anti-rotation notches 107 in the flange portion 104 prevent the fitting 103 from rotating in its opening. A metal diaphragm 110 formed, for example, of stainless steel or the like is located beneath the lower surface of the valve cover plate 101 and is retained in sealed engagement therewith about the periphery of the cover plate where it is fastened to the valve can. Moreover, a separate valve seat member 111 is fastened to the diaphragm 110 using, for example, Pliobond and a raised circular valve seat 112 is formed in the valve seat member 111 for closure by the poppet 113 in the manner described above with reference to the thermal fuel valve 50. Alternatively, the valve seat member 111 may be integral with the spud 103, which may be force fit into position from the under-side of the cover plate.

A valve actuator mechanism 114 includes the mentioned poppet 113, a two part bimetal assembly 115, and a heater 116. The bimetal assembly 115, which may be as described above, is supported by a mounting structure 117 including a ceramic block 118 formed for example, of Steatite, a pivot lever 119, a pivot plate 120 also, for example, of Steatite, and a Micalex insulator plate 121 all fastened together through respective holes by two rivets 122, 123, which also provide electrical connection for the two ends of the heater wire 116, respectively, to electrical terminals 124, 125. The bimetal assembly 115 is secured to the ceramic block 118 by the rivet 122 and is preferably welded to the latter at 126. A pair of downwardly turned circular flanged openings 127, 128 are formed in the steel diaphragm 110 to allow passage of the respective rivets 122, 123 therethrough, and a pair of O-rings seal the mentioned circular openings, only the O-ring 129 being visible in FIG. 5.

The pivot lever 119 has a pair of respective holes formed in the same to accommodate the respective rivets 122, 123, diaphragm circular flanged portions 127, 128 and O-rings 129, and a pair of upstanding and outwardly flaired arcuate ears 130, 131 on the pivot plate 120 support the mounting structure 117 within an opening 132 formed in the valve cover 101. The arcuate ears provide a relatively fixed pivot point for the mounting structure 117. Thus, the mounting structure 117 effectively floats within the opening 132 supported by the ears 130, 131 and to a degree by the steel diaphragm 110.

The moment arm 133 of the pivot lever 119 extends to a position for operation by a calibration screw 134 that passes through a threaded opening 135 formed in the valve cover 101. The diaphragm 110 separates the calibration screw 134 from direct engagement with the moment arm 133, and a number of circular corrugations 136 formed in the diaphragm permit resilient deformation of the same as the calibration screw 134 is screwed in and out of its opening 135 to move the pivot lever 119. Preferably the corrugations 136 have a resilient parameter that enables the diaphragm 110 to regain its illustrated configuration close to or directly in abutment with the valve cover plate 101 when the calibration screw is fully withdrawn, as shown in FIG. 5.

Operation of the thermal fuel valve 100 is similar to that described above with reference to the thermal fuel valve 50 shown in FIGS. 2, 3, and 4. Accordingly, a suitable electric current through the heater 116 causes the same to heat to a temperature that will effect bending in the bimetal assembly 115 to move the poppet 113 away from the valve seat 112 opening the valve outlet 103 and allowing gas to flow therethrough. The mechanical bias force normally maintaining the poppet 113 closed against the valve seat 112 is determined by the angular position of the mounting structure 117 with respect to the plane of the valve cover plate 101 as it rests within the opening 132. The mentioned angular position and bias force may be adjusted externally of the valve housing by a simple rotation of the calibration screw 134 while the diaphragm 110 maintains the sealed integrity of the valve. A calibration process may be effected, as described above, wherein the valve 100 is first calibrated for use with gas, for example, at four inches pressure after which the handle 140 is welded to the calibration screw 134 and a first stop 141 is welded to the top of the valve cover plate 101 to preclude further rotation of the calibration screw 134, thus setting the maximum mechanical bias force exerted against the poppet 113. A similar calibration procedure would also follow for use of the valve with gas at ten inches pressure, and a further stop 142 would be welded to the top of the valve cover plate 101. Thereafter, the valve 101 may be used with gas at either four inches or 10 inches pressure by simply moving the handle 140 to engagement with the appropriate stop 141, 142. Alternatively, the heads of the screws 102-1, 102-2 may provide the mentioned stop function for a handle 140 of appropriate width, as described above.

The embodiments of the invention in which an exclusive property or privilege is claimed are defined as follows:

1. A control circuit for a gas burner appliance having an electric igniter adapted for positioning proximate the burner port area and a fuel valve in the gaseous fuel line to the burner and including electrically operable means for opening the fuel valve, comprising: ignition circuit means for energization of said electric igniter and said electrically operable means to effect heating of said electric igniter and opening of said fuel valve, said energized electric igniter being capable of effecting ignition of fuel at the burner, hold circuit means for energization of the electric igniter independently of the fuel valve to maintain a source of heat in the appliance without fuel combustion, and control means for selective independent operation of said ignition circuit means and said hold circuit means.

2. A control circuit as set forth in claim 1, said electric igniter and said electrically operable means being connected for series energization in said ignition circuit means.

3. A control circuit as set forth in claim 2, the fuel valve comprising a thermal fuel valve having a heat responsive actuator, and the electrically operable means comprising an electric heater for heating said heat responsive actuator to effect opening of said thermal fuel valve.

4. A control circuit as set forth in claim 3, the electric igniter comprising a material having the properties of silicon carbide.

5. A control circuit as set forth in claim 1, said ignition and control circuit means being connected in parallel.

6. A control circuit as set forth in claim 5, further comprising means for limiting the maximum current flow in the control circuit.

7. A control circuit as set forth in claim 5, further comprising a temperature responsive selector switch responsive to the temperature of the gas appliance for supplying electric power to said ignition and control circuit means.

8. A control circuit as set forth in claim 1, said control means comprising a first switch means for connecting said ignition circuit means to a source of electric energy.

9. A control circuit as set forth in claim 1, said control means comprising hold switch means for connecting said hold circuit means to a source of electric energy.

10. A control circuit as set forth in claim 9, said control means further comprising further switch means for connecting said ignition circuit means to a source of electric energy, said further and hold switch means being oppositely operable, whereby only one of said ignition and hold circuit means is energized at a time.

11. A control circuit as set forth in claim 10, said control means further comprising timer operated switch means selectively operable for automatic sequential energization of said ignition and hold circuit means.

12. A control circuit as set forth in claim 1, said control means comprising timer operated switch means selectively operable for automatic sequential energization of said ignition and hold circuit means.

13. A control circuit as set forth in claim 1, further comprising an indicator light responsive to energization of at least one of said ignition and hold circuit means to indicate such energization.

14. A control circuit as set forth in claim 1, the fuel valve comprising selectively operable means for calibrating the same for use with different gaseous fuels at different respective pressures to permit the fuel to flow to the burner when the electric igniter has achieved a temperature approximately at which fuel ignition would occur.

15. A control circuit as set forth in claim 14, said fluid valve further comprising a fluid-tight housing having an inlet and an outlet, a valve element in said housing normally closing said outlet, a valve actuator normally maintaining said valve element in position to close said outlet and energizable to move said valve element to open said outlet, said valve actuator being mounted for pivotal movement with respect to said housing, and said selectively operable means for calibrating comprising adjustment means operable exteriorly of said housing for effecting such pivotal movement of said valve actuator thereby to effect adjustment of the normal outlet closing force of said valve element.

* * * * *